US005247854A

United States Patent [19]

Wu

[11] Patent Number: 5,247,854

[45] Date of Patent: Sep. 28, 1993

[54] FLY WHEEL DEVICE FOR BICYCLE EXERCISER

[76] Inventor: Mu-Chuan Wu, No. 23, Hai Huan Street, Tainan, Taiwan

[21] Appl. No.: 925,456

[22] Filed: Aug. 11, 1992

[51] Int. Cl.[5] ..... A63B 21/00

[52] U.S. Cl. ..... 74/572; 482/63; 482/64

[58] Field of Search ..... 74/572, 573 R, 574; 482/63, 64; 192/113 AD, 113 AP; D21/194

[56] References Cited

U.S. PATENT DOCUMENTS 4,007,927 2/1977 Proctor ..... 74/572 X
4,826,150 5/1989 Minoura ..... 74/572 X
4,917,377 4/1990 Chen ..... 74/572 X
5,031,901 7/1991 Saarinen ..... 482/63
5,145,480 9/1992 Wang ..... 482/63

FOREIGN PATENT DOCUMENTS 3603854 8/1987 Fed. Rep. of Germany ..... 74/572

*Primary Examiner*—Rodney H. Bonck
*Assistant Examiner*—Ryan W. Massey
*Attorney, Agent, or Firm*—Bacon & Thomas

[57] ABSTRACT

A fly wheel device for a bicycle exerciser having a fixing hub unit rotatively mounted on an exerciser frame for supporting a fly wheel made of inductive material. The fixing hub unit is integrally formed with an impeller for cooling the fly wheel device to maintain rotation resistance exerted on the fly wheel in a normal standard.

1 Claim, 3 Drawing Sheets

FLY WHEEL DEVICE FOR BICYCLE EXERCISER

BACKGROUND OF THE INVENTION

This invention relates generally to improvements in a load applying apparatus in an exerciser and more particular to an improved fly wheel device in a bicycle exerciser integrally provided with a cooling fan which enhances an accurate brake to a predetermined rotation resistance on the fly wheel.

In the heretofore conventional load applying apparatus utilized in an bicycle exerciser of this type, the apparatus includes a driven member or fly wheel made of inductive material and rotatively mounted on the frame of the bicycle exerciser, a U-shaped permanent magnet pivotally secured to the exerciser frame and a control knob provided for selectively locating the permanent magnet in one of a plurality of angular positions. Part of the driven member or fly wheel is interposed between two spaced legs of the permanent magnet to generate an eddy current in the driven member or fly wheel for exerting a rotation resistance on the fly wheel.

Such rotation resistance operation may generate heat which will be accumulated in the fly wheel and permanent magnet resulting in a drop to the rotation resistance and an inaccurate indication on a visual indicator of the exerciser.

SUMMARY OF THE INVENTION

The present fly wheel device overcomes the functional disadvantages of known convention load applying apparatus and circulates air to continuously diminish heat accumulation in the fly wheel device of bicycle exercisers.

The fly wheel device includes a fixing hub unit rotatively mounted on an exerciser frame and having a disc-like base formed with a central depression, six vanes equally and annularly distributed along the outer edge of the central depression and six air discharge passages each being cut on the bias relative to radial direction and communicating the central depression, a copper fly wheel and flange member mounted on the vanes of the fixing hub unit and a plurality of rivets for fastening the fixing hub unit, fly wheel and flange member together.

BRIEF DESCRIPTION OF THE DRAWINGS

FIG. 2A is a cross-sectional view taken along line A—A' in FIG. 2.

FIG. 2B a cross-sectional view taken along line B—B' in FIG. 2; and

DETAILED DESCRIPTION OF THE PREFERRED EMBODIMENT

Figure 1:
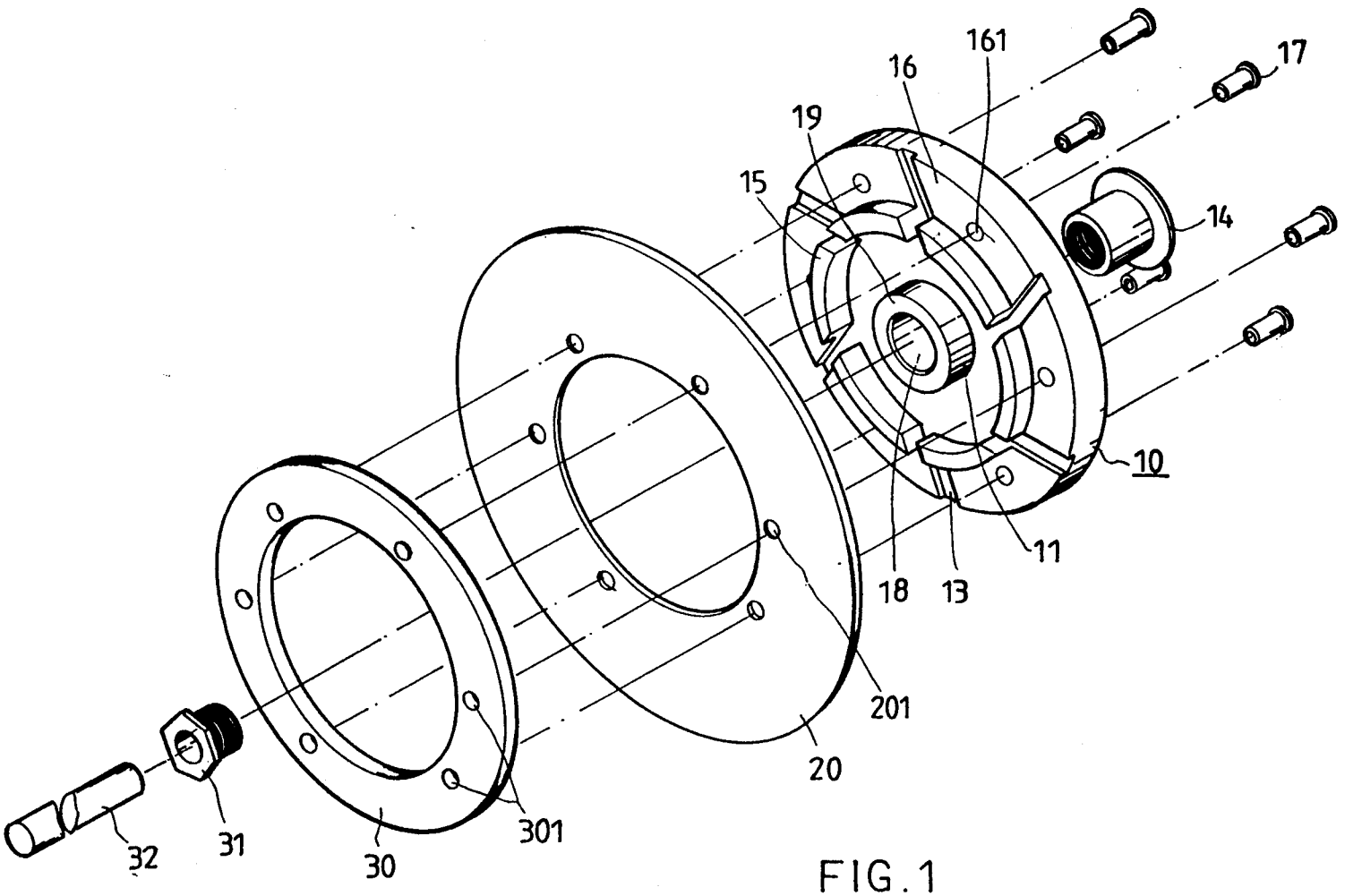
FIG. 1 is an exploded perspective view of a fly wheel device in accordance with the present invention.

Referring now by reference numerals to the drawings, and first to FIG. 1, the fly wheel device according to the present invention includes a fixing shaft 32 rotatably mounted on an exerciser frame, a disc fixing hub unit 10, which functions as an impeller, having an axial hole 18 defined by a hub 19 for fixedly mounting the hub unit 10 on the fixing shaft 32 through a cap nut 14 and bolt 31, a copper disc driven member or fly wheel 20 mounted on an end of the hub unit 10, a flange member 30 mounted on the same end as the copper fly wheel 20, abutting the copper fly wheel 20, of the hub unit 10 and a plurality of rivets 17 inserted through corresponding holes 161, 201, 301 which are respectively formed in the hub unit 10, fly wheel 20 and flange member 30.

The disc fixing hub unit 10 includes a generally disc-like base 16 with the holes 161 axially and evenly located therethrough. The end of the disc fixing hub unit 10 on which the copper fly wheel 20 and flange member 30 are provided has a central depression 11 located in the central portion of the base 16 and surrounding the hub 19. Six vanes 15 are equally spaced along the annular outer edge of the central depression 11 and rise axially from the base 16. Six air discharge passages 13 are grooved in the base 16 and pass the portions between adjacent ends of the vanes 15 to communicate the central depression 11. Each of the air discharge passages 13 extends along a biased path relative to a radial direction to the outer periphery of the base 16.

Referring to FIGS. 2A and 2B, the fly wheel 20 and flange member 30 are formed with central holes for mounting the same sequentially on the outer periphery of the vanes 15 of the disc fixing hub unit 10. The flange member 30, fly wheel 20 and disc fixing hub unit 10 are fastened together by means of the rivets 17.

Figure 3:
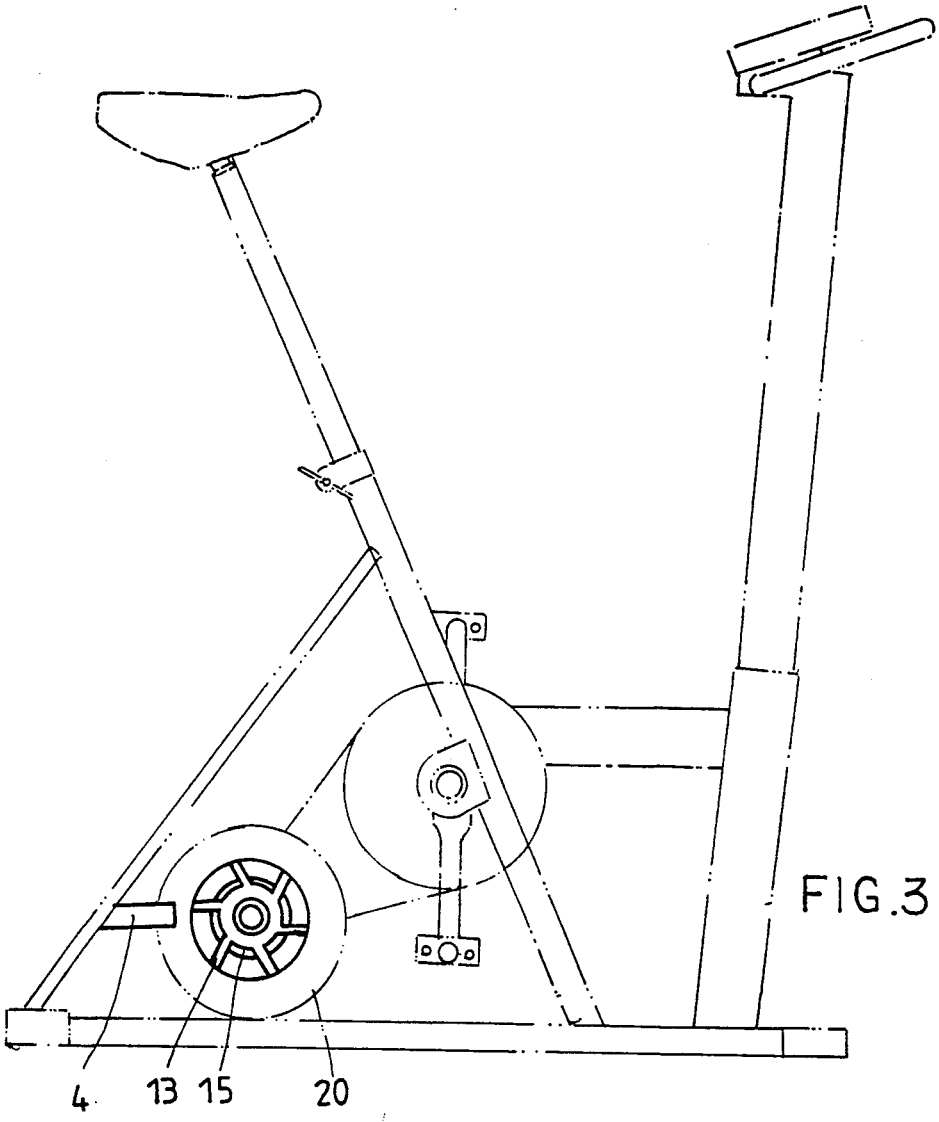
FIG. 3 is an elevational view of the fly wheel device illustrating the device mounted on a bicycle exerciser.

Referring to FIG. 3, the fly wheel device is rotatively mounted on an exerciser frame with part of the fly wheel 20 interposed between two spaced legs of a conventional U-shaped permanent magnet 4 to generate an eddy current in the fly wheel for exerting a rotation resistance on the fly wheel as described previously. As is conventional, an appropriate drive means such as a foot pedal and sprocket-chain connection with the fly wheel device whereby the user can rotate the fly wheel 20 by leg power.

Figure 2:
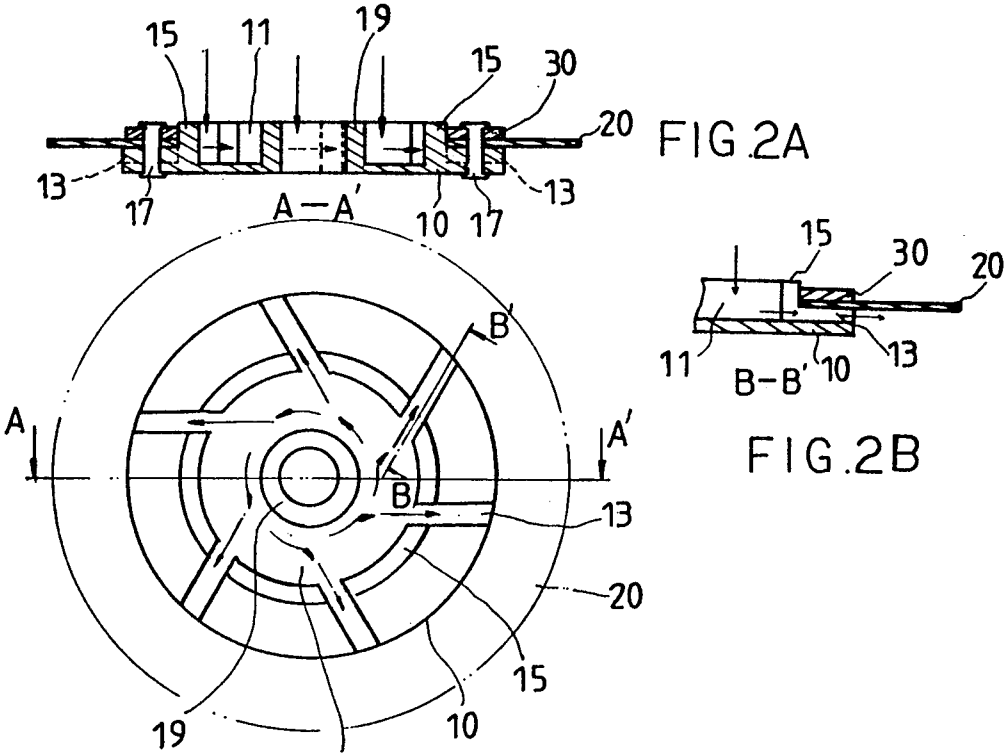
FIG. 2 is an elevational view of the fly wheel device wherein a fly wheel is illustrated in phantom.

In operation, air will be pumped in the direction of arrows and discharged through the air discharge passages 13, as shown in FIGS. 2 and 2B, to cool the fly wheel device in which heat is accumulated. To this end, rotation resistance of a load applying device containing the fly wheel device of this invention can be maintained in a normal standard and an accurate indication on a visual indicator, if any, can thus be achieved.

What is claimed is:

1. A fly wheel device for a bicycle exerciser comprising:

a fixing hub member rotatively mounted on an exerciser frame and having a disc-like base;

a depression disposed in a central portion of a major side of the base;

a plurality of vanes equally spaced along an annular outer edge of the depression and projected from the base along an axial direction;

a plurality of air passages grooved in the base along a biased path relative to a radial direction with a first end of each of the air passages communicating the depression and a second end terminated at an outer periphery of the base;

a fly wheel made of inductive material and having a central hole adapted for mounting on the vanes;

a flange member having a central hole adapted for mounting on the vanes and abutting the fly wheel; and fasteners for securing the fixing hub member, fly wheel and flange member in position.

* * * * *